US006341904B1

(12) United States Patent
Ojima

(10) Patent No.: US 6,341,904 B1
(45) **Date of Patent: *Jan. 29, 2002**

(54) IMAGE FORMING APPARATUS AND IMAGE FORMING PROCESS

(75) Inventor: Kimi Ojima, Hino (JP)

(73) Assignee: Konica Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/484,915

(22) Filed: Jan. 18, 2000

(30) Foreign Application Priority Data

Jan. 21, 1999 (JP) ..... 11-012645

(51) Int. Cl.[7] ..... B41J 2/00; B41J 3/42; B41J 11/44

(52) U.S. Cl. ..... 400/118.2; 400/61; 400/70; 400/76

(58) Field of Search ..... 400/118.2, 61, 400/70, 76; 250/316–319

(56) References Cited

U.S. PATENT DOCUMENTS 5,578,824 A * 11/1996 Koguchi et al. ..... 250/318
6,078,251 A * 6/2000 Landt et al. ..... 340/10.41
6,099,178 A * 8/2000 Spurr et al. ..... 400/207

FOREIGN PATENT DOCUMENTS

EP 0 645 251 A1 * 3/1995
JP 5-221067 8/1993

* cited by examiner

*Primary Examiner*—Ren Yan
*Assistant Examiner*—Charles H. Nolan, Jr.
(74) *Attorney, Agent, or Firm*—Frishauf, Holtz, Goodman, Langer & Chick, P.C.

(57) ABSTRACT

An image forming apparatus,-in which an ink sheet is superimposed onto an image receiving sheet and subjected to imagewise exposure to light to allow an image in the ink sheet to transfer to the image receiving sheet to form an image is disclosed, comprising a drum, an exposure device, a detecting device for detecting quality information of the ink sheet and/or image receiving sheet, a memory device for memorizing an exposure condition corresponding the quality information, and a control device for controlling the exposure device and/or the drum.

7 Claims, 1 Drawing Sheet

IMAGE FORMING APPARATUS AND IMAGE FORMING PROCESS

FIELD OF THE INVENTION

The present invention relates to ink sheets, image receiving sheets, an image forming apparatus, an image forming process, and an integrated control system of an image forming system and an image forming apparatus.

BACKGROUND OF THE INVENTION

Recently, along with the spread of image forming techniques of digitized images, the need for direct digitized color proof (also denoted as DDCP) production have increased specifically in the field of printing. In the process of printing, it is generally necessary to prepare a hard copy prior to proceeding the final printing step and a method of using an image forming apparatus for preparing to a hard copy is needed to check finished prints.

JP-A 5-221067 (hereinafter, the term, JP-A means an unexamined and published Japanese Patent Application) discloses an apparatus for performing constant, rapid and accurate image forming by using a thermal transfer process that constantly produces high quality, definite proof images. This thermal image forming apparatus is provided with a roller medium-supplying apparatus and has a support on which an ink sheet is overlapped onto an image receiving sheet, wherein even when plural ink sheets are overlapped on an image receiving sheet, the ink sheets can be removed without disordering the image receiving sheet, a part of the image receiving sheet is held and the position of superimposed plural images is confirmed while writing, multicolored images are formed on the image receiving sheet and then the images are transferred all at once onto a print paper to prepare a final proof.

An ink sheet and an image receiving sheet used in such an image forming apparatus are desired to be uniform in quality in terms of sheet layer thickness, density and sensitivity, in cases when both are the same kinds of products. However, the quality, depending of the manufacturing conditions, varies more or less and are not always uniform. Exposure of such an ink sheet and image receiving sheet having fluctuation in quality to light by using an exposure apparatus under given constant conditions, leads to formation of images having fluctuations in quality, in response to variation in quality of image forming materials. Such fluctuation in image quality is not acceptable when the resulting images are used as proofs. The present invention was made to solve such problems, and provides an image forming apparatus and an image forming process, which enable final images having a stabilized constant quality to be produced even when using ink sheets or image receiving sheets having some fluctuations.

In general, a sheet describing product information including a product name and color is usually attached to an outer carton of ink sheets or image receiving sheets. When loading image forming materials such as the ink sheet and image receiving sheet into an image forming apparatus, information regarding the size, kind, color and so on, is recognized by a person, often producing problems such as operation failure or plenty of time and labor being needed.

The image forming materials further contain a number of information items to be controlled in addition to the information regarding the product name and color, so that it has been unfeasible to allow such information to correspond to various types of products.

Image forming apparatuses have been individually employed by each user and plural apparatuses have never been subjected to concentrated control, while being connected with each other. Further, the state of using image forming materials at the user side could not be collectively controlled. Accordingly, there were produced problems such that a response to troubles which occurred at the time of image formation was delayed and scheduled production was not feasible, thereby lowering the production efficiency.

According to the present invention, there has been provided ink sheets, image receiving sheets, an image forming apparatus and an image forming system, in which product information can be recognized in a accurate and simple manner, thereby reducing labor costs; and an integrated control system, in which information regarding various kinds of products can be collectively controlled, enhancing production efficiency of image forming materials and enabling instantaneous response to troubles which occur at the time of image formation. Further, according to the invention, there has been provided an image forming process, an image forming system and an integrated control system of image forming apparatuses, whereby image exhibiting reduced variation in dot gain and superior resolution can be stably obtained in a simple manner independent of a finally image-received material.

SUMMARY OF THE INVENTION

Accordingly, an object of the present invention is to provide ink sheets, image receiving sheets, an image forming apparatus and an image forming system, in which product information can be recognized in an accurate and simple manner, thereby reducing labor cost.

Further, an object of the invention is to provide an image forming process, an image forming system and an integrated control system of image forming apparatuses, whereby image exhibiting reduced variation in dot gain and superior resolution can be stably obtained in a simple manner independent of a final image receiving material.

Furthermore, an object of the invention is to provide an integrated control system, in which information regarding various kinds of products can be collectively controlled, enhancing production efficiency of image forming materials and enabling instantaneous response to troubles which occur at the time of image formation.

The objects of the present invention can be accomplished by the following constitution:

(1) An image forming apparatus, in which an ink sheet is superimposed onto an image receiving sheet and subjected to imagewise exposure to light to allow an image in the ink sheet to transfer to the image receiving sheet to form an image, comprising:

a drum around which the ink sheet and/or image receiving sheet are wound, an exposure device for exposing the ink sheet and/or image receiving sheet wound around the drum, while rotating the drum, a detecting device for detecting quality information of the ink sheet and/or image receiving sheet, a memory device for memorizing an exposure condition corresponding the quality information of the ink sheet and/or image receiving sheet, and a control device for controlling the exposure device and/or the drum so that the exposure is performed according to the exposure condition corresponding to the quality information of the ink sheet and image receiving sheet which has been detected by the detecting device and memorized by the memory device;

(2) The image forming apparatus described in (1), wherein an image in a first ink sheet is transferred to the image receiving sheet and then an image in a second ink sheet having a color different from the first ink sheet is transferred to the image receiving sheet;

(3) The image forming apparatus described in (1), wherein the exposure condition is a circumferential speed of the rotating drum;

(4) The image forming apparatus described in (1), wherein the exposure condition is an emission intensity of a light source built in the exposure device;

(5) The image forming apparatus described in (1), wherein the exposure device has a laser light source to perform laser exposure;

(6) The image forming apparatus described in (1), wherein the quality information is at least one of sensitivity, density and layer thickness of the ink sheet and/or the image receiving sheet;

(7) The image forming apparatus described in (1), wherein the detecting device has a bar-code reader;

(8) The image forming apparatus described in (1), wherein the detecting device has a magnetic head;

(9) The image forming apparatus described in (1), wherein the memory device and the exposure device are both built in an integrated apparatus;

(10) The image forming apparatus described in (1), wherein a part including the memory device and a part including the drum, the exposure device, the control device and the detecting device are separated; the part including the exposure device comprising a quality information sending means for sending the quality information detected by the detecting device and an exposure condition receiving means for receiving the exposure condition sent by an exposure condition sending means; and the part including the exposure device further comprising a quality information receiving means for receiving the quality information sent by the quality information sending means and an exposure condition sending means for sending the exposure condition memorized by the memory device and corresponding to the quality information;

(11) an image forming process in which an ink sheet is superimposed onto an image receiving sheet, they are wound around a drum and imagewise exposed with rotating the drum to allow an image in the ink sheet to transfer to the image receiving sheet to form an image therein, the process comprising the steps of:

detecting quality information of the ink sheet and/or image receiving sheet, determining an exposure condition corresponding the detected quality information, and performing exposure, based on the determined exposure condition;

(12) The image forming process described in (11), wherein an image in a first ink sheet is transferred to the image receiving sheet and then an image in a second ink sheet having a color different from the first ink sheet is transferred to the image receiving sheet;

(13) The image forming process described in (11), wherein the exposure condition is a circumferential speed of the rotating drum;

(14) The image forming process described in (11), wherein the exposure condition is an emission intensity of a light source used in exposure;

(15) The image forming process described in (11), wherein exposure is performed with laser;

(16) The image forming process described in (11), wherein the quality information is at least one of sensitivity, density and layer thickness of the ink sheet and/or the image receiving sheet;

(17) An ink sheet containing quality information in advance as an image forming material;

(18) The ink sheet described in (12), wherein the quality information is at least one selected from sensitivity and density;

(19) An image receiving sheet containing quality information in advance as an image forming material;

(20) The image receiving sheet described in (14), wherein the quality information is at least one selected from sensitivity and density;

(21) An image forming apparatus having a mechanism of automatically detecting quality information which has been provided to an image forming material;

(22) A process of forming an image by using an image forming material containing quality information and an image forming apparatus, wherein the image forming apparatus detects the quality information contained in the image forming material and the detected quality information is employed for image recording control;

(23) An image forming system comprising means for automatically detecting quality information which has been provided to an image forming material, means for thereby controlling an image forming condition and means for recording an image;

(24) The image forming system described in (23), wherein the image forming condition is an exposure condition;

(25) An integrated control system for integrally controlling plural image forming apparatuses, wherein an image forming condition corresponding to quality information of an image forming material is allowed to be memorized by a controller in advance, the quality information of the image forming material which is automatically detected by an image forming apparatus is sent, as data signals, to the controller, the data signals corresponding to the image forming condition corresponding to the quality information is sent to the image forming apparatus to control the image forming apparatus so that the image forming apparatus performs image recording according to the sent image forming condition;

(26) The integrated control system described in (25), wherein a message corresponding to error information at the time of image formation is allowed to be memorized by a controller in advance, the error information detected by an image forming apparatus is sent, as data signals, to the controller and the message is exhibited on a monitor;

(27) The integrated control system described in (25), wherein the image forming condition is an exposure condition; and

(28) The integrated control system described in (26), wherein the quality is at least one selected from sensitivity and density, and the image forming condition is an exposure condition.

DETAILED DESCRIPTION OF THE INVENTION

Figure 1:
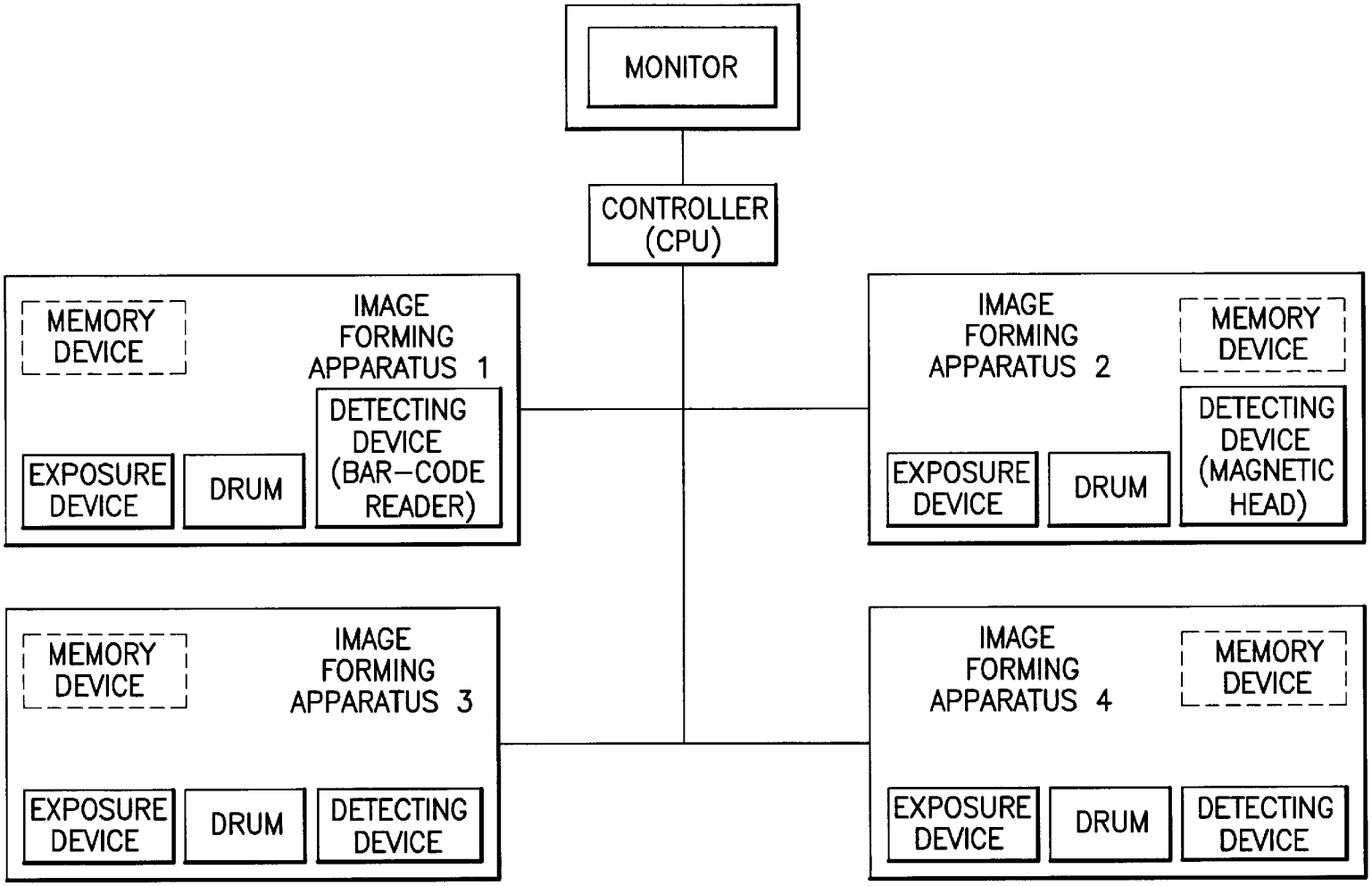
FIG. 1 illustrates an integrated control system of an image forming apparatus according to an embodiment of the invention.

In one preferred embodiment of the image forming process according to the present invention, images are formed on an image receiving sheet using a thermal transfer process and the images are transferred to a final image receiver.

Specifically, a high power laser thermal transfer process is preferred. Using plural ink sheets such as yellow, magenta, cyan and black ink sheets and a single image receiving sheet, for example, the image of each ink sheet is thermally transferred to the image receiving sheet so that various color images are overlapped to form a final color image on the image receiving sheet. An ink-jet process and electrophotography process are applicable.

In the laser thermal transfer process used in the invention, the thermal transfer process of an ink sheet may be any one of thermal transfer by melting, transfer by ablation and thermal transfer by sublimation, in which a laser beam is converted to heat and employing the heat energy, ink is transferred to an image receiving sheet to form an image on the image receiving sheet. Specifically, melting-ablation type thermal transfer is preferred in terms of formation of images having color tone close to printed images.

After forming an image on the image receiving sheet, superimposing a final receiver, the image is allowed to transfer onto the final receiver by applying heat or pressure to finally form a proof.

Ink Sheet

The ink sheet used in the laser thermal transfer process is exemplarily a film having a light-to-heat converting function and an ink (or colorant) transfer function, which comprises a support having thereon a layer having a light-to-heat converting function, an ink layer and optionally, between these layers, a cushion layer or peeling layer. Further, a back coat layer may be provided on the side opposite to the layer having a light-to-heat converting function and the ink layer.

Supports used in the invention may be any one which is rigid, superior in dimensional stability and flatness and resistant to heat at the time of image formation. Exemplarily are usable films or sheets described in JP-A 63-193886 at page 2, left lower column, line 12–18. Specifically are preferred plastic resin films including polyethylene terephthalate, polyethylene naphthalate, polycarbonate, nylon, poly(vinyl chloride), polystyrene, poly(methyl methacrylate), syndiotactic polystyrene and polypropylene. The plastic film may be further subjected to a modification treatment to enhance dimensional stability or antistatic property. A sublayer may be provided so that each of layers described below is favorably coated on the support.

In cases where laser light is irradiated from the back-side of the ink sheet to form images, the support is preferably transparent to laser light. The support preferably has rigidity and flexibility suited to transport.

In the thermal transfer by laser-melting, the ink layer is preferably a layer in which a layer containing a colorant and binder is entirely transferable. In this case, the layer may not be transferred to the receiver in the completely melting state. The support is preferably 50 to 150 $\mu$m thick.

Examples of the colorants include inorganic pigments such as titanium dioxide, carbon black, graphite, zinc oxide, Prussian blue, cadmium sulfide, iron oxide, lead, zinc, barium chromate and calcium chromate; organic pigments such as azo type, thioindigo type, anthraquinone type, anthanthrone type, and triphenedioxane type pigments, vat dyes and pigments, phthalocyanine pigments and their derivatives, and quinacridone pigments; and dyes such as acid dyes, direct dyes, disperse dyes, oil-soluble dye, metal-containing oil-soluble dyes and sublimation type dyes. In cases of color proof materials, C.I. 21095 or C.I. 21090, C.I. 15850, and C.I. 74160 are preferably used as yellow, magenta and cyan dyes, respectively. The content of the colorant in the ink layer is adjusted so as to give a desired density in a desired layer thickness and specifically not limited, but preferably 5 to 70% by weight, and more preferably 10 to 60% by weight.

Binders used in the ink layer include thermo-fusible substances, thermo-softening substances and thermo-plastic substances. The thermo-fusible substances are solid or semi-solid materials exhibiting a melting point of 40 to 150° C. which is usually measured by using YANAGIMOTO type MJP-2. Examples thereof include plant wax such as carnauba wax, Japan wax, auricurie wax and espar wax; animal wax such as honey wax, insect wax, shellac wax and whale wax; petroleum wax such as paraffin wax, microcrystal wax, polyethylene wax, ester wax and acid wax; mineral wax such as montan wax, ozocerite, and ceresine; higher fatty acids such as palmitic acid, stearic acid, margaric acid, and behenic acid; higher alcohols such as palmityl alcohol, stearyl alcohol, behenyl alcohol, marganyl alcohol, myristyl alcohol, and eicosanol; higher fatty acid esters such as cetyl palmitate, cetyl stearate, and myricyl stearate; amides such as acetoamide, propionic acid amide, palmitic acid amide, stearic acid amide, and amide wax; higher amines such as stearylamine, behenylamine, and palmitylamine. Examples of the thermoplastic resins include ethylene type copolymer resin, polyamide type resin, polyester type resin, polyurethane type rein, polyolefin type resin, acryl type resin, vinyl chloride type resin, cellulose type resin, rosin type resin, polyvinyl alcohol type resin, polyvinyl acetal type resin, ionomer type resin, petroleum type resin, and resins used for an ink layer, as described in JP-A 6-312583. Of these, resins exhibiting a melting point or softening point of 70 to 150° C. are preferred. Besides thermoplastic resins described above are also usable natural rubber, elastomers such as styrene-butadiene rubber, isoprene rubber, chloroprene rubber, and diene type copolymer; rosin derivatives such as ester gum, rosin maleic acid resin, rosin phenol resin, and hydrogenated rosin; phenol resin, terpene resin, cyclopentadiene resin and aromatic hydrocarbon resin. Optimally selecting the thermo-fusible substances or thermoplastic substances, a tranferable ink layer having desired thermo-softening point or melting can be formed.

In the invention, using a high thermo-degradable binder, image formation can be achieved by ablation transfer. As such a binder are cited polymer materials capable of causing rapid acid-catalyzed partial degradation, preferably at a temperature of not higher than 200° C. when measured in the equlibrium state. Examples thereof include nitrocelluloses, polycarbonates and polymers such a type as described in J. M. J. Frechet, F. Bouchard, J. M. Houlihan B. Kryczke and E. Eichler; J. Imaging Science, 30(2) 59–64 (19869, polyurethanes, polyesters, polyorthoesters, polyacetals and their copolymers. These polymers including degradation mechanism are detailed in the above-described reference of Houlihan. High density can be achieved by enhancing particle size homogeneity, as described in JP-A 62-158092.

The use of various types of dispersing agents is preferred to hold dispersion of a pigment and achieve superior color reproduction. There may be further incorporated a plasticizer to enhance sensitivity by plasticizing the ink layer, a surfactant to enhance coatability of the ink layer and fine particles of an order of submicron to micron to prevent blocking of the ink layer (e.g., matting agent). The ink layer is preferably 0.1 to 0.7 $\mu$m thick.

In light of color reproduction of transferred images, a light-to heat conversion layer can be provided separately from the ink layer though the light-to-heat conversion layer is not needed in cases where a light-to-heat converting material is incorporated into the ink layer. The light-to-heat conversion layer can be provided adjacently to the ink layer.

In the invention, it is preferred to provide the light-to-heat conversion layer. Light-to-heat converting materials, depending on the kind of a light source are preferably those which efficiently convert absorbed light to heat. In cases where a semiconductor laser is used as a light source, for example, a material having absorption in the near-infrared region is preferred. Preferred examples of near-infrared absorbents include carbon black, organic compounds such as cyanine type, polymethine type, azulenium type, squalenium type, thiopyrrilium type, naphthoquinone type, and anthraquinone type dyes and organic metal complexes such as phthalocyanine type, azo type and thioamide type, as described in JP-A 63-139191, 64-33547, 1-160683, 1-280750, 1-293342, 2-2074, 3-26593, 3-30991, 3-34891, 3-36093, 3-36094, 3-36095, 3-42281, 3-97589 and 3-103476. These may be used alone or in combination.

The binder used in the light-to-heat conversion layer is preferably a resin exhibiting a high Tg and high heat conductivity, including commonly known heat resistant resins poly(methyl methacrylate), polycarbonate, polystyrene, ethyl cellulose, nitrocellulose, poly(vinyl alcohol), poly) vinyl chloride), polyamide, polyimide, poly(ether imide), polysulfone, poly(ether sulfone), and aramid; polythiophenes; polyanilines; polyacetylenes; polyphenylenes; poly(phenylene sulfides); polypyrroles; and their derivatives or mixture.

Aqueous soluble polymers are also used as a binder of the light-to-heat conversion layer. The aqueous soluble polymers are preferred in terms of superiority in peelability from the ink layer and heat resistance at the time of laser exposure and little scattering when excessively heated. When used in combination with the aqueous soluble polymer, it is preferred to modify the light-to-heat converting material to enhance aqueous solubility (e.g., by introducing a sulfo group) or to use it in the form of an aqueous dispersion. Incorporation of various types of releasing agents into the light-to-heat conversion layer enhances peelability of the light-to-heat conversion layer from the ink layer and sensitivity. Examples of effective releasing agents include silicone type releasing agents (e.g., polyoxyethylene-modified silicone oil, alcohol-modified silicone oil, etc.), fluorine type surfactants (e.g., perfluorophosphoric acid ester type surfactants) and other various types of surfactants.

The light-to-heat conversion layer is preferably 0.1 to 3 $\mu$m thick, and more preferably 0.2 to 1.0 $\mu$m thick. The light-to-heat converting material in the light-to-heat conversion layer is preferably incorporated in an amount giving an absorbance of 0.3 to 3.0, and more preferably 0.7 to 2.5 at the wavelength of a light source. In cases when carbon black is used as a light-to-heat conversion layer, the light-to-heat conversion layer thickness of more than 1 $\mu$m tends to reduce sensitivity though no burning of the ink layer due to over-heating takes place. The layer thickness, depending on exposed laser power or absorbance of the light-to-heat conversion layer, is optimally selected.

A vapor-deposited layer can be used as a light-to-heat conversion layer. Examples thereof include a metal-deposited layer including metal black of gold, silver, aluminum, chromium, nickel, antimony, tellurium, bismuth and selenium; metals of Ib, Iib, IIIa, iVb, Vb, Via, Vib, VIIb and VIII elements of the periodical table or their alloys, or alloys of these metal elements and a Ia, IIa or IIIb element. Suitable metal oxides or sulfides include compounds of Al, Bi, Sn, In, Zn, Ti, Cr, Mo, W, Co, Ir, ni, Pb, Pt, Cu, Ag, Au, Zr and Te, and a mixture thereof. Vapor-deposited layers of metal phthalocyanines, metal dithilenes and anthraquinones are also included. The vapor-deposited layer thickness is preferably not more than 500 Å.

The light-to-heat converting material may be a colorant itself and is not limited to compounds described above. In cases where the light-to-heat conversion layer is deteriorated in adhesion to a sublayer of the support, when an ink sheet is peeled off from an image receiving sheet after light exposure or thermal transfer, frilling often occurs, resulting in color contamination. Therefore, an adhesion layer may be provided on the sublayer of the support. Employed as the adhesion layer are commonly known adhesives including polyester, urethane and gelatin. In place of the adhesion layer, an adhesion-providing agent or an adhesive may be incorporated into a cushion layer.

The cushion layer is so provided that the ink sheet is brought into close contact with the image receiving sheet. The cushion layer is thermo-softening or elastic layer. Materials capable of thermally softening or deforming or having a low elasticity or rubber elasticity may be usable.

The cushion layer has cushion-ability. The elastic modulus or needle injection degree is employed as a measure of the cushion-ability. For example, a layer exhibiting an elastic modulus of 1 to 250 kg/mm2 at 25° C. or a needle injection degree of 15 to 500, and preferably 30 to 300, as specified by JIS K2530-1, is confirmed to exhibit preferred cushion-ability. However, the required extent thereof depends on the intended use of images. The cushion layer preferably exhibits a TMA softening point of 70° C. or lower, and more preferably 60° or lower. Although preferred characteristics of the cushion layer do not necessarily depend on only the kind of material, preferred materials include polyolefin resin, ethylene-ethyl acrylate copolymer, polybutadiene resin, styrene-butadiene copolymer (i.e., SBR)styrene-ethylene-butene-styrene copolymer (SEBS), acrylonitrile-butadiene copolymer (NBR), polyisoprene resin (IR), styrene-isoprene copolymer (SIS), acrylic acid ester copolymer, polyester resin, polyurethane resin, acryl resin, butyl rubber and polynorbornene. Of these materials, those which have a relatively low molecular weight tend to meet the requirements of the invention. The cushion layer can be formed by non-aqueous coating and also be coated in the form of an aqueous dispersion such as latex or emulsion. Aqueous soluble resin can be used. These resins may be used alone or in combination.

In addition to the compounds described above, incorporation of various adjuvants favorable characteristics to the cushion layer. Examples of such adjuvants include low melting substances such as wax and plasticizers, such as phthalic acid esters, adipinic acid esters, fatty acid esters, phosphoric acid esters, and chlorinated paraffins. Further, various types of additives described in "Handbook of Additives for Rubber and Plastics" published by KAGAKUKOGYO-SHA (1972). The amount of these additives to be incorporated is selected so as to provide favorable physical property in combination with chemicals contained in the cushion layer and preferably not more than 10% by weight, and more preferably not more than 5% by weight, based on the total amount of components of the cushion layer.

The cushion layer can be formed by coating (using a blade coater, roll coater, bar coater, curtain coater or gravure coater), by lamination (e.g., hot melt extrusion lamination) or by sandwiching film. The cushion layer may further be finished by coating to enhance surface flatness. A resin layer having void structure, s a specific type of the cushion layer may be used, in which thermo-softening or thermo-plastic foamed resin is employed. Further to form a filling cushion layer in which surface flatness is dispensable, coating is conducted by various coating methods. The cushion layer is preferably 0.5 to 10 $\mu$m thick, and more preferably 1 to 7 $\mu$m thick.

Image Receiving Sheet

Image receiving sheets used in the invention basically comprise a support having thereon an image receiving layer. Specifically, an image receiving sheet is preferred, in which having on one side of the support a back coat layer and on the other side a cushion layer and further thereon an image receiving layer. Supports used in the image receiving sheet are the same as used in the ink sheets. The support may be transparent or colored, and preferably has rigidity and flexibility suited for transport.

Commonly used polymeric materials are used as binder of the image receiving layer, including gelatin poly(vinyl alcohol), methyl cellulose, nitrocellulose, acetylcellulose, aromatic polyamide resin, silicone resin, epoxy resin, alkyd resin, phenol resin, melamine resin, fluororesin, polyimide resin, urethane resin, acryl resin, urethane-modified silicone resin, polyethylene resin, polypropylene resin, polyester resin, Teflon resin, poly(vinyl butyral) resin, vinyl chloride type resin, poly(vinyl acetate), polycarbonate, organic boron compound, aromatic esters, polyfluorourethane and polyether sulfon.

Aqueous soluble binder capable of being cross-linked may be used in the back coat layer and allowed to be cross-linked, whereby powdery dropping of a matting agent is prevented and antiarbration of the back coat is enhanced. An anti-blocking effect during storage is also enhanced. Cross-linking means employ any one or a combination of heat, actinic rays and pressure in accordance with characteristics of the cross-linking agent to be used. Alternatively, an adhesion layer may optionally be provided on the back coat side to enhance adhesion to the support.

Organic or inorganic fine particles are employed as a matting agent of the back coat layer. Examples of organic matting agents include fine particles of radical polymerization type polymers such as polymethyl methacrylate (PMMA), polystyrene, polyethylene, polypropylene and other polymers; and fine particles of condensation polymers such as polyester and polycarbonate. The coverage of the back coat layer is preferably 0.5 to 5 g/m$^2$. The coverage of less than 0.5 g/m$^2$ is unstable in coating behavior, producing problems such as powdery dropping. The coverage of more than 5 g/m$^2$ excessively increases the particle size of a mating agent, causing embossing on the image receiving layer surface by the back coat and easily producing missing or non-uniformity of recorded images, especially when a thin ink layer is thermally transferred. The number-averaged particle size of the matting agent is preferably larger by 2.5 to 20 $\mu$m than the back coat thickness of binder alone. Particles with 8 $\mu$m or more in size of not less than 5 mg/m$^2$ (and preferably 6 to 600 mg/m$^2$) is needed in the matting agent, whereby foreign matter troubles are improved. A value of a standard deviation of particle size, divided by a number-averaged particle size ($\delta$/rn, i.e., coefficient of variation of particle size) is preferably not more than 0.3, thereby, defects caused by extraordinarily large particles are improved and desired performance can be achieved by a smaller amount thereof. The coefficient of variation is more preferably not more than 0.15.

An antistatic agent is preferably incorporated into the back coat layer to prevent adhesion of foreign matter due to triboelectric charging caused by friction with transport rollers. Cationic surfactants, anionic surfactants, nonionic surfactants, polymer antistatic agents, conductive fine particles and compounds described in "11290 Chemical Products" published by KAGAKUKOGYO NIPPO-SHA page 875–876 are broaly employed as antistatic agents. Exemplary preferred antistatic agent used in the back coat layer include conductive fine particles such as carbon black, metal oxides such as zinc oxide, titanium oxide and tin oxide and semiconductors. The use of the conductive fine particles is preferred since the antistatic agent is not released from the back coat layer and stable antistatic effects are obtained without dependence of environment.

To provide coatability or releasability to the back coat layer, releasing agents such as various kinds of surfactants, silicone oil and fluororesin may be incorporated into the back coat layer. The back coat layer preferably exhibits a TMA softening point of 70° C. or less, which is determined by thermomechanical analysis (denoted as TMA). The TMA softening point can be determined by heating the measurement object at a constant speed, while loading a given weight and observing a phase of the object. In the invention, a temperature at which the phase of the object starts to soften is defined as a TMA softening point. Measurement of the softening point by TMA is conducted using an apparatus such as Thermoflex available from RIGAKU DENKI Co. Ltd.

The cushion layer provided in the image receiving sheet is the same as used in the ink sheet. The image receiving layer of the image receiving sheet will be further described. The image receiving layer comprises binder and optionally various additives. The image receiving layer preferably exhibit a TMA softening point of 70° C. or lower (and more preferably 60° C. or lower) and 30° C. or higher.

Preferred exemplary binders used in the image receiving layer include adhesives such as polyvinyl acetate emulsion type adhesives, chloroprene type adhesives and epoxy resin type adhesives; tacky adhesives such as natural rubber, chloroprene rubber type, butyl rubber type, polyacrylic acid ester type, nitrile rubber type, polysulfide type, silicone rubber type and petroleum type resins; regenerated rubber, vinyl chloride type resin, SBR, polybutadiene resin, polyisoprene, polyvinyl butyral resin, polyvinyl ether resin, ionomer resin, SIS, SEBS, acryl resin, ethylene-vinyl chloride copolymer, ethylene-acryl copolymer, ethylene-vinyl acetate resin (EVA), vinyl chloride-grafted EVA resin, EVA-grafted vinyl chloride resin, urethane resin, polyester resin, polyolefin resin, and various types of modified resins. The binder thickness of the image receiving layer is preferably 0.8 to 2.5 $\mu$m.

The image receiving layer preferably contains a matting agent. The number-averaged particle size is preferably larger by 1.5 to 5.5 $\mu$m than the average thickness of an image receiving layer containing no matting agent. The matting agent is contained preferably in an amount of 0.02 to 0.2 g/m$^2$. This levels of the added matting agent is favorable to maintain optimally close contact with an ink sheet in thermal transfer (especially in laser thermal transfer recording) using a thin ink sheet. More preferred matting agent is one in which the number-averaged particle size is preferably larger by 1.5 to 5.5 $\mu$m than the average thickness of an image receiving layer containing no matting agent and at least 70% of the total particles are included within this range.

A peeling layer may be provided between the image receiving layer and the cushion layer of the image receiving sheet. The peeling layer is effective when images formed in the image receiving layer is transferred to a final receiver from the image receiving sheet. Preferred and exemplary binder usable in the peeling layer include polyolefin, polyester, polyvinyl acetal, polyvinyl formal, polyparabenic acid, polymethyl methacrylate, polycarbonate, ethyl cellulose, nitrocellulose, methyl cellulose, carboxymethyl cellulose, hydroxypropyl cellulose, polyvinyl alcohol, polyvinyl chloride, urethane resin, fluororesin, styrenes such as polystyrene and poly(acrylonitrile styrene) and these cross-linked resins, thermo-setting resins such as polyamide, polyimide, polyetherimide, polysulfon, polyether sulfon and aramid, which exhibit a Tg of 65° C. or higher, and their hardened resins. The commonly used hardening agent are employed, including isocyanates and melamin. Taking into account of physical properties described above, the binder used in the peeling layer is preferably polycarbonate, acetal or ethyl cellulose in terms of storage stability; specifically, the use of an acryl type resin in the image receiving layer is preferred since peeling is superior when thermally transferred images are further transferred. Further, a layer of which adhesion to the image receiving layer is markedly lowered on cooling is usable as a peeling layer. Exemplarily, the layer mainly contains wax, thermo-fusible compounds such as binder or thermo-plastic resins. The thermo-fusible compounds are, for example those which are described in JP-A 63-193886. Specifically, microcrystalline wax, paraffin wax and carnauba wax are preferred. The therm-plastic resin is preferably ethylenic copolymer such as ethylene-vinyl acetate type resin and cellulose type resin. Higher fatty acids, higher alcohols, higher fatty acid eaters, amides or higher amines may be incorporated into such a peeling layer.

Another constitution of the peeling layer is a layer which is melted or softened on heating, causing cohesive failure and providing peelability. It is preferred to incorporate a supercooling substance into such a peeling layer. Examples of the supercooling substance include poly-ϵ-caprolactone, polyoxyethlene, benzotriazole, tribenzylamine and vanillin.

Further, in another constitution of the peeling layer, a compound capable of lowering adhesion to the image receiving layer is incorporated thereto. Examples of such a compound include silicone type resin such as silicone oil; fluororesin such as Teflon and fluorine-containing acryl resin; polysiloxane resin; acetal type resin such as polyvinyl butyral, polyvinyl acetal and polyvinyl formal; solid waxes such as polyethylene wax and amide wax; and fluoro- or phosphate-type surfactants.

The peeling layer can be formed on the cushion layer by coating a solution or a latex-like dispersion of materials described above by means of a blade coater, roll coater, bar coater, curtain coater or gravure coater, or by the hot-melt extrusion lamination method. Alternatively, the solution or latex-like dispersion of the materials described above is coated on a temporary base by the coating method described above; then, the coat is laminated with a cushion layer and the temporary base is peeled off. The peeling layer is preferably 0.3 to 3.0 $\mu$m thick. When the peeling layer is too thick, effects of the cushion layer are hardly displayed, so that an adjustment is needed according to the kind of the peeling layer.

Final receiver

Employed as a final receiver are commonly known printig paper, art paper coat paper, matte paper, Yupo paper, wood free paper, synthetic paper, regenerated paper, OHP paper, glass, pottery, metal, fabrics and the supports used in the invention. Specifically, art paper and coat paper are preferred for use in producing color proofs.

Quality Information

Quality information includes any information regarding quality of image forming material products such as product information of the kind or color of products. Specifically, information describing quality of image forming materials which affects the exposure condition is preferred. Exemplarily, it includes the size, weight, thickness, color, density and sensitivity of ink sheets or image receiving sheets, and preferably thickness, density and sensitivity. Further, the thickness and color of the support of ink sheets and/or image receiving sheets may be treated as quality information.

The form of the quality information includes any one capable of memorizing information, such as letters, numerals, notation, bar code, magnetic recording, IC and surface protrude; and bar code and surface protrusion or recession are preferred.

The quality information may be attached to the sheet itself, a core around which the sheet is wound, or packaging material; and preferably to the sheet itself. In cases when attached to the packaging material, it is preferred that the information is printed in the form of notation onto an outer carton, for example, using the ink-jet process; or printed or labeled in the form of bar code or magnetic recording onto the outer carton. In cases when attached to the sheet, it is preferred that the information is longitudinally notched, printed or labeled in the corner of the sheet.

Image Forming Apparatus

In the image forming apparatus according to the invention, an ink sheet is superimposed onto an image receiving sheet and subjected to imagewise exposure to light to allow an image in the ink sheet to transfer to the image receiving sheet to form an image; the image forming apparatus comprises a drum around which the ink sheet and/or image receiving sheet are wound, an exposure device for exposing the ink sheet and/or image receiving sheet wound around the drum with rotating the drum, a detecting device for detecting quality information of the ink sheet and/or image receiving sheet, a memory device for memorizing an exposure condition corresponding the quality information of the ink sheet and/or image receiving sheet, and a control device for controlling the exposure device and/or the drum so that the exposure is performed according to the exposure condition corresponding to the quality information of the ink sheet and image receiving sheet which has been detected by the detecting device and memorized by the memory device.

The exposure device is preferably one having a laser light source and undergoing laser exposure.

The detecting device may be either a contact sensor or non-contact sensor according to the form of the detected information. Examples thereof include a bar code reader for reading bar code, magnetic head for reading magnetic information, a sensor for reading the surface protrusion or recession, notches or the for of holes, and scanner for reading letters or notations. This mechanism may be provided outside of the image forming apparatus or inside of the apparatus.

The memory device memorizes the exposure conditions corresponding the quality information of the ink sheet and/or image receiving sheet. The exposure conditions include the laser output power and the rotation speed of the drum. For example, in response to the quality information of the sensitivity being low, the thickness being thick and the density being high, the exposure condition is preferably to raise the laser output power or to reduce the rotation speed of the drum. Further, in response to the quality information of the sensitivity being high, the thickness being thin and the density being low, the exposure condition is preferably to lower the laser output power or to raise the rotation speed of the drum. The exposure condition is preferably the rotation speed of the drum in terms of easy control. Preferred examples of the memory device include a memory such as RAM (DRAM, SDRAM, flush memory, miniature card, compact flush, smart media, PC card, etc) or ROM (including mask ROM, EP-ROM, EEP-ROM, etc.), hard disk, floppy disk, CR-ROM, CD-RW, CD-R, DVD-ROM, MO, MT, DAT and a recording and reading apparatus of these disks.

The control device controls the exposure device so that exposure is performed according to the exposure condition (which is memorized in the memory device,) corresponding the quality information detected by the detecting device. Exemplary examples thereof include CPU, DSP, and custom IC. Thus, first, the detecting device detects the quality information recorded in the ink sheet of image receiving sheet, or the outer carton or package thereof. The exposure condition corresponding to the detected quality information is read out of the memory device and the control device controls the exposure device or the drum so that exposure is performed according to the read exposure condition to form images using the ink sheet and image receiving sheet. It is preferred that when a image forming material is loaded onto the image forming apparatus, the quality information is detected and the exposure condition is automatically set.

The memory device and the exposure device may be collectively built in the image forming apparatus. Alternatively, the memory device may be separately provided. In this case, the memory device is allowed to be included in a server or a computer and it can be connected to one or plural exposure devices using telephone network or radio transmission. Integrating the memory device, one or plural exposure devices, and telephone network, these may be regarded as an image forming apparatus or an image forming system. In this case, the portion having the exposure device contains a quality information sending device to send the quality information detected by the detecting device and an exposure condition receiving device to receive the exposure condition sent by an exposure condition sending device; and the portion having the exposure device contains a quality information receiving device to receive the quality information sent by the quality information sending device and the exposure condition sending device to send the exposure condition in response to a quality information receiving means and memorized in the memory device. Exemplary examples of these receiving devices and sending devices include a modem. Examples of the sending devices and receiving devices include an analog modem, network card, Ta, ATM, PIAFS and ASDL. The cases where the memory device is separately provided will be described below.

Integrated Control System of Image Forming Apparatus

FIG. 1 illustrates an example of a system applied in the invention. As shown therein, there are provided paths of control signals to control each of connected image forming apparatuses and data signals of the quality information detected by each image forming apparatus. Control of each image forming apparatus or monitoring of information from the image forming apparatuses becomes feasible by allowing the control signals to contain an instruction code comprising various information and controlling signals.

Information detected by the image forming apparatuses can be collectively and concentratedly managed. Further, in cases when a trouble occurs during image formation, control signals are sent to the image forming apparatus from the remote location, enabling to control the image forming apparatus. In this case, it is preferred that control signals to control the image forming apparatus are sent to the image forming apparatus through remote control, based on the display of a monitor. Further, it is preferred that when the information detected by each image forming apparatus is sent as data signals, the data signals are recognized as a concrete message and displayed on the monitor. The information detected by each image forming apparatus may be successively sent and controlled. Alternatively, the information may be sent to control it only when a manager needs.

EXAMPLES

Example 1

Preparation of Ink Sheet

Ink sheet 1:

On a 75 μm thick PET base (t100, available from MITSUBISHI Chemical Polyester Co. Ltd.) support, a cushion layer coating solution having the composition described below was coated using a reverse coater and dried to a 6 μm thick cushion layer. Then, before reeling, a light-to-heat conversion layer coating solution was coated on the cushion layer by wire bar coating and dried to form a light-to-heat conversion layer having a transmission absorbance of 0.85 at the wavelength of 830 nm. The coverage of the light-to-heat conversion layer is 0.55 g/m$^2$.

Cushion Layer Coating Solution

| | |
|---|---|
| Styrene/ethylene/butadiene/styrene resin (Kraton G1657, available from Shell Chemical Corp.) | 14 parts |
| Tackifier (Superester A100, available from ARAKAWA KAGAKU Co. Ltd.) | 6 parts |
| Methyl ethyl ketone | 10 parts |
| Toluene | 80 parts |

Light-to-Heat Conversion Layer Coating Solution

| | |
|---|---|
| Polyvinyl alcohol (Gosenol EG-30, available from NIHON GOSEI KAGAKU Co. Ltd.) | 6 parts |
| Carbon black dispersion (converted to solid) (SD-9020, available from DAINIPPON INK Co. Ltd.) | 4 parts |
| Water | 490 parts |

On the opposite side of the sheet to the light-to-heat conversion layer, a back coat layer coating solution having the composition described below was coated by wire bar coating and dried to form a back coat layer having a coverage of 1.0 g/m$^2$. Then, before reeling, an ink layer coating solution 1 having the composition described below was coated on the cushion layer by wire bar coating and dried to form a 0.5 μm thick ink layer. Thus, Ink sheet 1 was prepared.

Back Coat Layer Coating Solution

| | |
|---|---|
| Polyester resin (Biron 200, available From TOYOBC Co. Ltd.) | 9 parts |
| PMMA resin particle (MX-1000, available from SOKEN KAGAKU Co. Ltd.) | 1 part |
| Silicone oil (X-24-8300, available from SHINETSU KAGAKU Co. Ltd.) | 5 parts |
| Methyl ethyl ketone | 75 parts |
| Cyclohexanone | 10 parts |

Ink Layer Coating Solution 1

| | |
|---|---|
| Magenta pigment dispersion (MHI Magenta #785, available fram MIKUNI SHIKISO Co. Ltd.) | 48 parts |
| Styrene/acryl resin (Highmer SBM73F available from SANYO KASEI Co. Ltd.) | 8.7 parts |

-continued

| | |
|---|---|
| Ethylene/vinyl acetate resin (Evaflex, EV40Y available from MITSUI Du Pont Polychemical Corp.) | 0.9 parts |
| Fluoro-surfactant (Surflon S-382, available from ASAHI GLASS Co. Ltd.) | 0.4 parts |
| Methyl ethyl ketone | 25 parts |
| Cyclohexanone | 16 parts |

Ink sheet 2:

Ink sheet 2 was prepared in the same manner as in Ink sheet 1, except that the following ink sheet layer coating solution 2 was used.

Ink Layer Coating Solution 2

| | |
|---|---|
| Magenta pigment dispersion (MHI Magenta #1038, available from MIKUNI SHIKISO Co. Ltd.) | 48 parts |
| Styrene/acryl resin (Highmer SBM73F available from SANYO KASEI Co. Ltd.) | 8.7 parts |
| thylene/vinyl acetate resin (Evaflex EV40Y available from MITSUI Du Pont Polychemical Corp.) | 0.9 parts |
| Fluoro-surfactant (Surflon S-382, available from ASAHI GLASS Co. Ltd.) | 0.4 parts |
| Methyl ethyl ketone | 25 parts |
| Cyclohexanone | 16 parts |

Preparation of Image Receiving Sheet

On a 100 μm thick PET base (t100, available from MITSUBISHI Chemical Polyester Co. Ltd.) support, acryl type latex (Yodosol AD92K, available from KANEBO NSC Co. Ltd.) was coated by an applicator and dried to form a 20 μm cushion layer.

Then, on the cushion layer, a peeling layer coating solution having the composition described below was coated by wire bar coating and dried to form a 1.7 μm thick peeling layer; continuously, further thereon, an image receiving layer coating solution having the composition described below was coated by wire bar coating and dried to form a 1.5 μm thick image receiving layer.

Peeling Layer Coating Solution

| | |
|---|---|
| Ethyl cellulose (Ethocel 10, available from Dow Chemical Corp.) | 10 parts |
| Isopropyl alcohol | 90 parts |

Image Receiving Layer Coating Solution

| | |
|---|---|
| Acryl resin latex (Yodosol A5805, available from NIHON NSC Co. Ltd., resin 55%) | 25 parts |
| Matting agent, aqueous 30 wt % dispersion (MX-40S, available from SOKEN KAGAKU Co. Ltd.) | 1.8 parts |
| Fluororesin (Yunidain TG-810, Available from Daikin Industrial Co. Ltd.) | 4.2 parts |
| Isopropyl alcohol | 6 parts |
| Water | 90 parts |

On the oppsite side of the sheet to the image receiving layer, the following back coat layer coating solution was coated by wire bar coating and dried to form a back coat layer having the coverage of 1.0 g/m$^2$. Thus, the image receiving sheet was prepared.

Back Coat Layer Coating Solution

| | |
|---|---|
| Polyester resin (Biron 200, available From TOYOBO Co. Ltd.) | 8.7 parts |
| PMMA resin particle (MX-1000, available from SOKEN KAGAKU Co. Ltd.) | 0.3 part |
| Silicone oil (X-24-8300, available from SHINETSU KAGAKU Co. Ltd.) | 0.1 parts |
| Toluene | 20 parts |
| Methyl ethyl ketone | 25.9 parts |
| Cyclohexanone | 40 parts |

The thus prepared ink sheet and image receiving sheet each were wound around a core to prepare rolls thereof.

Ink sheet rolls each were 600 mm in width and image receiving sheet rolls each were 580 mm in width.

Quality Information of Ink sheet and Image Receiving Sheet

The length in width of each product roll (also denoted as "L"), the reflection density and sensitivity were included as quality information, which are also denoted as "D" and "S", respectively. The reflection density was measured by reflection densitometer (GRETAG D-186) and the sensitivity is represented by the maximum rotation number at which images are capable of being transferred when exposed to laser light, while rotating the drum with increasing the rotation speed.

Form of Quality Information

The quality information was included in the form of attachment of labels describing the quality information (also denoted as "Lab"), attachment of magnetic recording (also denoted as "Mag") or printing of bar codes (also denoted as "Bar").

Position of Quality Information

In Table 1, the term "carton" means the outside of an outer carton containing products and "sheet" means the corner of the sheet.

Image Forming Apparatus

There were employed an image forming apparatus having a sensor automatically detecting quality information attached to an image forming material such as an ink sheet or an apparatus not having such a sensor. The exposure condition for every quality information is memorized in the apparatus having the sensor automatically detecting the quality information, in which an image forming material is loaded in the apparatus so that the quality information is detected and the exposure condition is automatically set.

TABLE 1

| | Ink Sheet Quality Information | | | | | Image Receiving Sheet Quality information | | | | |
|---|---|---|---|---|---|---|---|---|---|---|
| Exp. No. | Sample No. | Pres./ Abs.*2 | Kind | Form | Position | Pres./ Abs.*2 | Kind | Form | Position | Apparatus*1 |
| 1 | Ink Sheet 1 | Pres. | S | Bar | Sheet | Abs. | — | — | — | Pres. |
| 2 | Ink Sheet 2 | Pres. | D | Lab | Sheet | Abs. | — | — | — | Pres. |
| 3 | Ink Sheet 2 | Pres. | D | Bar | Carton | Abs. | — | — | — | Pres. |
| 4 | Ink Sheet 1 | Pres. | S | Mag | Carton | Abs. | — | — | — | Pres. |
| 5 | Ink Sheet 1 | Pres. | L | Mag | Carton | Abs. | — | — | — | Pres. |
| 6 | Ink Sheet 2 | Pres. | L | Bar | Sheet | Abs. | — | — | — | Pres. |
| 7 | Ink Sheet 1 | Abs. | — | — | — | Pres. | D | Bar | Sheet | Pres. |
| 8 | Ink Sheet 2 | Abs. | — | — | — | Pres. | D | Bar | Carton | Pres. |
| 9 | Ink Sheet 1 | Abs. | — | — | — | Pres. | D | Lab | Sheet | Pres. |
| 10 | Ink Sheet 1 | Abs. | — | — | — | Pres. | D | Mag | Carton | Pres. |
| 11 | Ink Sheet 2 | Abs. | — | — | — | Pres. | L | Bar | Sheet | Pres. |
| 12 | Ink Sheet 1 | Abs. | — | — | — | Pres. | L | Mag | Carton | Pres. |
| 13 | Ink Sheet 2 | Pres. | S | Bar | Sheet | Pres. | D | Bar | Sheet | Pres. |
| 14 | Ink Sheet 2 | Pres. | D | Bar | Sheet | Pres. | D | Bar | Sheet | Pres. |
| 15 | Ink Sheet 1 | Pres. | L | Bar | Sheet | Pres. | D | Lab | Sheet | Pres. |
| 16 | Ink Sheet 1 | Pres. | S | Mag | Carton | Pres. | L | Bar | Carton | Pres. |
| 17 | Ink Sheet 2 | Pres. | D | Mag | Carton | Pres. | L | Mag | Carton | Pres. |
| 18 | Ink Sheet 1 | Pres. | L | Bar | Carton | Pres. | L | Lab | Sheet | Pres. |
| 19 | Ink Sheet 2 | Abs. | — | — | — | Abs. | — | — | — | Pres. |
| 20 | Ink Sheet 2 | Pres. | S | Bar | Sheet | Pres. | D | Bar | Sheet | Abs. |
| 21 | Ink Sheet 1 | Pres. | D | Bar | Carton | Pres. | L | Lab | Sheet | Abs. |
| 22 | Ink Sheet 1 | Pres. | L | Bar | Sheet | Abs. | — | — | — | Abs. |
| 23 | Ink Sheet 2 | Abs. | — | — | — | Pres. | D | Bar | Sheet | Abs. |

*1The presence or absence of a sensor automatically detecting quality information
*2The presence or absence of quality information Laser thermal transfer was conducted to form images, based on the combination of an ink sheet, image receiving sheet and an image forming apparatus, as shown in Table 1. Obtained images were evaluated with respect to variation of dot gain and resolution, according to the following manner. Art paper or a 30 cm thick aluminum sheet was used as a final image receiver.

Variation of Dot Gain

An ink sheet was superimposd onto an image receiving sheet and wound around an exposure drum of the image forming apparatus. The exposure drum had plural suction pores so that the ink sheet and the image receiving sheet were brought into close contact with the drum surface under reduced pressure. The image receiving sheet in roll was fed toward the exposure device, cut to a given length on the way and wound around the exposure drum, while being maintained in contact with the drum. Subsequently, the ink sheet in roll was fed toward the exposure device, cut to a given length on the way and wound around the exposure drum. Then, semiconductor laser (830 nm) was irradiated from the ink sheet side and outputting a wedge-formed image was repeated 30 times. Using a laminator (DX-700, available from Tokyo Laminex Co. Ltd.), the transferred image on the image receiving was further transferred to the art paper or the aluminum sheet to obtain a final image. The thus obtained wedge images of 30 times repetition each were measured by a reflection densitometer (GRETAG D-186) with respect to the 50% dot gain and evaluated based on the following criteria:

A: Dot gain variation of not more than 3%

E: Dot gain variation of more than 3%.

Resolution

The ink sheet was superimposed onto the image receiving sheet and wound around an exposure drum of the image forming apparatus. Then, semiconductor laser (830 nm) was irradiated from the ink sheet side to output 10 sheets having fine lines and halftone dot images of 175 lines per inch. Thus obtained images were visually evaluated using a loupe. The average value of the 10 sheets was classified based on the following criteria:

A: Reproduction of 4,000 dpi

B: Reproduction of 2,000 dpi

C: Reproduction of 1,000 dpi

D: Reproduction of 500 dpi

E: Reproduction of 250 dpi

Evaluation results are shown in Table 2.

TABLE 2

| Experi- | Dot Gain variation | | Resolution | | |
|---|---|---|---|---|---|
| ment No. | Art Paper | A1. sheet | Art paper | A1. Sheet | Remark |
| 1 | A | A | A | B | Inv. |
| 2 | A | A | B | B | Inv. |
| 3 | A | A | B | B | Inv. |
| 4 | A | A | B | B | Inv. |
| 5 | A | A | B | C | Inv. |
| 6 | A | A | C | B | Inv. |
| 7 | A | A | B | A | Inv. |
| 8 | A | A | B | B | Inv. |
| 9 | A | A | B | B | Inv. |
| 10 | A | A | B | B | Inv. |
| 11 | A | A | C | B | Inv. |
| 12 | A | A | B | C | Inv. |
| 13 | A | A | A | A | Inv. |
| 14 | A | A | A | A | Inv. |
| 15 | A | A | A | A | Inv. |
| 16 | A | A | A | A | Inv. |
| 17 | A | A | A | A | Inv. |
| 18 | A | A | A | A | Inv. |
| 19 | E | E | E | E | Comp. |
| 20 | E | E | E | E | Comp. |
| 21 | E | E | E | E | Comp. |
| 22 | E | E | E | E | Comp. |
| 23 | E | E | E | E | Comp. |

As can be seen from Table 2, recognition of the quality information was automatically conducted in the inventive examples. Thus, after loading the image forming material into the image forming apparatus, even when an operator did nothing, images with little variation in dot gain and superior resolution were automatically obtained without depending on the final image receiver. In comparative examples, on the other hand, the operator himself had to recognize the quality information and set the corresponding image forming condition, so that it took a lot of time. Applying an integral control system to the apparatus, as shown in FIG. 1, the amount of image forming materials to be used was displayed on a monitor and successively controlled, enabling scheduled production and resolution of problems relating to lots of stock or urgent production. Further, in cases where a trouble occurs during image formation, the trouble is displayed on the monitor to confirm details thereof so that precise instructions can be given.

EFFECT OF THE INVENTION

According to the present invention even when using ink sheets or image forming sheet with a slight fluctuation in quality, a final image of constant quality (e.g., with little variation in dot gain or stable resolution) can be readily obtained. In addition, recognition of product information can be accurately and simply performed, thereby enabling labor costs to be reduced. And of course, the embodiments of the present invention disclosed herein can be varied by a skilled person without departing from the spirit and scope of the invention.

What is claimed is:

1. A centralized control system for integrally controlling plural image forming apparatuses, wherein the image forming apparatuses each superpose an ink sheet onto an image receiving sheet and perform imagewise exposure so as to cause an image on the ink sheet to be transferred to the image receiving sheet to form an image, the control system comprising:

memory means for prestoring respective exposure conditions corresponding to respective quality information of at least one of the ink sheet and image receiving sheet;

control means for controlling each of the image forming apparatuses to perform image recording according to one of the exposure conditions which is prestored in the memory means and which corresponds to quality information detected by each of the image forming apparatuses, wherein the ink sheet comprises a support having thereon a light-to-heat conversion layer and an ink layer, and the image receiving sheet comprises a support having thereon a cushion layer and an image receiving layer.

2. The control system of claim 1, wherein the image forming apparatuses each comprise a drum around which at least one of the ink sheet and the image receiving sheet is wound and an exposure device that exposes the at least one of the ink sheet and the image receiving sheet wound around the drum while rotating the drum, and wherein the image forming apparatuses each further comprise means for detecting the quality information of at least one of the ink sheet and the image receiving sheet.

3. The control system of claim 2, wherein the exposure condition is a circumference speed of the drum of one of the image forming apparatuses.

4. The control system of claim 2, wherein the exposure condition is an emission intensity of a light source in the exposure device of one of the image forming apparatuses.

5. The control system of claim 1, wherein the quality information comprises at least one of a sensitivity, density and layer thickness of at least one of the ink sheet and the image receiving sheet.

6. The control system of claim 2, wherein the means for detecting quality information comprises a bar-code reader.

7. The control system of claim 1, wherein the means for detecting quality information comprises a magnetic head.

* * * * *